US006283149B1

(12) United States Patent
Hayashi et al.

(10) Patent No.: US 6,283,149 B1
(45) Date of Patent: Sep. 4, 2001

(54) DIRECTIONAL CONTROL VALVE HAVING POSITION DETECTING FUNCTION

(75) Inventors: Bunya Hayashi; Makoto Ishikawa, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/593,487

(22) Filed: Jun. 14, 2000

(30) Foreign Application Priority Data

Jul. 12, 1999 (JP) ..... 11-197776

(51) Int. Cl.[7] ..... E03B 7/07

(52) U.S. Cl. ..... 137/554; 137/625.64; 137/625.65; 137/884

(58) Field of Search ..... 137/625.65, 625.64, 137/554, 884

(56) References Cited

U.S. PATENT DOCUMENTS 5,244,002 * 9/1993 Frederick ..... 137/1
5,623,967 4/1997 Hayashi .
5,829,481 * 11/1998 Tajima et al. ..... 137/884

FOREIGN PATENT DOCUMENTS 2-66784 5/1990 (JP) .
2-66785 5/1990 (JP) .
2-88079 7/1990 (JP) .

* cited by examiner

*Primary Examiner*—A. Michael Chambers
(74) *Attorney, Agent, or Firm*—Oblon, Spivak, McClelland, Maier & Neustadt, P.C.

(57) ABSTRACT

The present invention aims to provide a directional control valve excellent in the detecting accuracy and the operational stability and having a position detecting function, wherein the magnet is prevented from directly contacting hydraulic fluid so as not to be affected by the hydraulic fluid. To achieve this, a magnet 21 is installed on an end portion of the valve member 6 received in the valve hole 5 so as to be situated at a position which is adjacent to a breathing chamber 9 and which is more exterior than an end sealing member 8 which shuts off the breathing chambers from the hydraulic fluid passages, and also a magnetic sensor 22 is installed at a position opposite to the magnet 21, in a casing 4, whereby the magnetic sensor 22 detects the magnetic flux density when the magnet 21 moves together with a spool 6, and detects all operating positions of the spool 6 during a stroke, from the change in the magnetic flux density.

20 Claims, 3 Drawing Sheets

DIRECTIONAL CONTROL VALVE HAVING POSITION DETECTING FUNCTION

TECHNICAL FIELD

The present invention relates to a directional control valve having a position detecting function, improved by permitting the detection of operating positions of a valve member such as a spool, through the use of a magnet.

BACKGROUND ART

The directional control valve capable of detecting the changeover operation of a spool utilizing a magnet is well known as disclosed in, for example, Japanese Unexamined Utility Model Publication No. 2-66784. This known directional control valve is provided with a magnet on the outer periphery of a spool and provided with a magnet sensor on a casing. This directional control valve is constituted so that, when the spool moves to one changeover position, the magnet approaches the magnetic sensor, and the magnetic sensor is turned on, and that, when the spool moves to the other changeover position, the magnet moves away from the magnetic sensor, and the magnetic sensor is turned off. This directional control valve is thus adapted to detect that the spool has been changed over by the on/off of the magnetic sensor.

However, since the above-described conventional directional control valve installs the magnet at a position situated in a fluid passage on the outer periphery of the spool, the magnet directly contacts the hydraulic fluid. Therefore, when the fluid contains water, chemical mist, particulates of magnetic material such as metallic powder, or the like, there has often arisen the problem that the contact of the magnet with these substances makes the magnet rust, corrode, or adsorb the particulates, thereby causing the reduction in detection accuracy due to the decrease in magnetic force, or incurring poor sliding conditions.

Furthermore, since the above-described conventional directional control valve uses the method in which the changeover of the spool is detected by the turning on/off of the magnetic sensor, any position on the way of a stroke can not be known, even if that the spool has reached each of the two stroke ends can be known. It is, therefore, substantially impossible to know whether the spool has normally operated during the whole stroke and reached a stroke end or not. This has created a problem in the reliability or the maintenance in executing automatization.

DISCLOSURE OF INVENTION

The main technical problem of the present invention is to provide a directional control valve excellent in the detecting accuracy and the operational stability and having a position detecting function, wherein the magnet is prevented from directly contacting a hydraulic fluid so as not to be affected by the hydraulic fluid.

The other technical problem of the present invention is to permit the above-described directional control valve having a position detecting function to detect the operating positions of the valve member over the whole stroke thereof.

In order to solve the above-described problems, the directional control valve of the present invention mounts the magnet for position detecting at a position, shut off from the flow passage of hydraulic fluid, at the end portion of the valve member received in a valve hole, and also installs the magnetic sensor for detecting the magnetism from the magnet at a portion opposite to the magnet, in the casing.

In accordance with the present invention having above-described features, since the magnet for position detecting is disposed at a position shut off from the flow passages of a hydraulic fluid, the magnet is prevented from directly contacting the hydraulic fluid. Therefore, even if the pilot fluid contains water chemical mist, particles of magnetic material such as metallic particles, or the like, there is no risk of the magnet rusting, corroding, or adsorbing particulates. This prevents the reduction in function, or the occurrence of a malfunction of the valve member due to adsorbed particulates.

In accordance with a specific embodiment of the present invention, the above-described directional control valve comprises breathing chambers which are opened to the outside, and which are situated at positions facing the ends of the valve member and end sealing members which are disposed on the outer peripheries and which shut off the breathing chambers from the fluid passages in the valve hole, and the above-described magnet is installed at a position which is adjacent to the breathing chamber and which is more exterior than the end sealing member disposed on an end portion of the valve member.

In the present invention, the magnet may be directly installed on the outer periphery of the valve member, or may be installed on the end portion of the valve member via a holder.

Also, the present invention may be provided with one magnet and one magnetic sensor, or may be provided with one magnet and a plurality of magnetic sensors.

In accordance with another specific embodiment of the present invention, the above-described magnetic sensor is installed so as to be able to detect the magnetism from the magnet over the whole stroke of the valve member, and is constituted so as to be able to detect all operating positions of the valve member, from the change in magnetic flux density with the displacement of the magnet.

Thereby, not only the stroke end positions of the piston, but also any position on the way of a stroke can be known. It is therefore possible to easily discriminate, by means of a discrimination circuit, whether the valve member has normally operated or not, from the relations between the position and the operating time of the valve member from the initiation to the termination of a stroke thereof. This permits taking precautionary measures against a failure before it happens, and preventing the occurrence of a long downtime of a working system due to a failure or an accident.

DETAILED DESCRIPTION OF THE INVENTION

Figure 1:
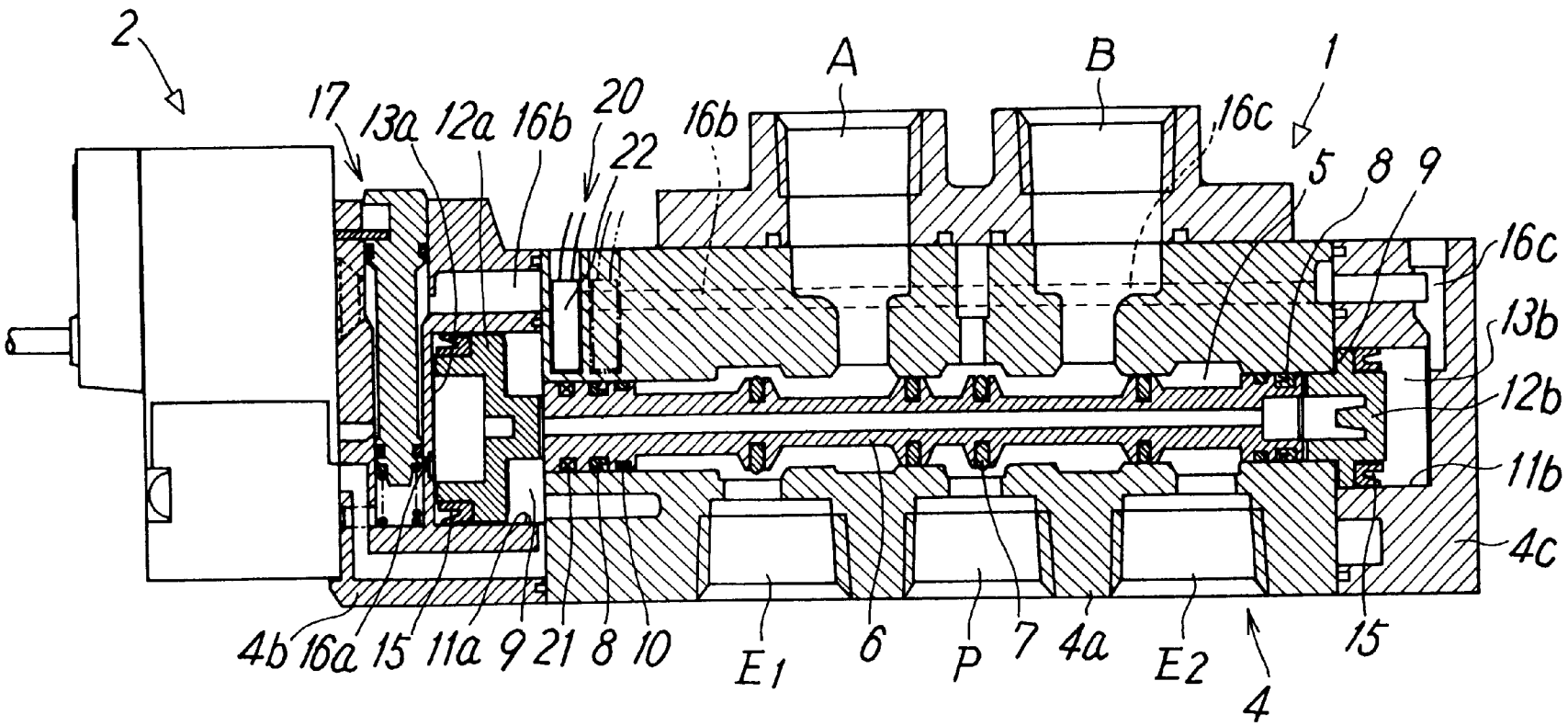
FIG. 1 is a longitudinal sectional view of a first embodiment of the directional control valve in accordance with the present invention.

FIG. 1 shows the first embodiment of the directional control valve in accordance with the present invention. The directional control valve here exemplified is a single-pilot type directional control valve wherein a main valve 1 is changed over by one pilot valve 2.

The main valve 1 has a construction as a 5-port valve, and includes a casing 4 constructed of non-magnetic material. The casing 4 comprises a first member 4a which is disposed at the central part and has a substantially cuboid shape, a second member 4*b* which is connected to one end of the first member 4*a* and which also serves as an adapter for mounting the pilot valve 2, and a third member 4*c* which is connected to the other end of the first member 4*a* and which functions as an end cover.

A supply port P and two discharge ports E1 and E2 are provided on either of the upper and lower surfaces of the first member 4*a*, and two output ports A and B are provided on the other surface. Inside the first member 4*a*, there is provided a valve hole 5 to which these ports are each opened being arranged in the axial direction. In the valve hole 5, there is slidably received a spool 6 which is a valve member for changing over flow passages and which is constructed of non-magnetic material.

On the outer periphery of the spool 6, there are provided a plurality of sealing members 7 for mutually defining flow passages connecting the above-mentioned ports, and on the outer peripheries of both end portions of the spool 6, there are provided respective end sealing members 8 for shutting off the breathing chambers 9 facing the end portions of the spool 6, from some flow passages. Reference numeral 10 in FIG. 1 denotes a guide ring for stabilizing the sliding of the spool 6.

On the other hand, in the second member 4*b* and the third member 4*c*, the piston chamber 11*a* and 11*b* are formed, respectively, at positions facing both ends of the spool 6. A first piston chamber 11*a* formed in the second member 4*b* has a large diameter, and a first piston 12*a* of large diameter is slidably received in the first piston chamber 11*a*, while a second piston chamber 11*b* formed in the third member 4*c* has a smaller diameter than the first piston chamber 11*a*, and a second piston 12*b* of small diameter is slidably received in the second piston chamber 11*b*. These pistons 12*a* and 12*b* are each abutted against the end faces of the spool 6. On the back sides of the pistons 12*a* and 12*b*, that is, on the sides opposite to the end faces of the pistons abutting against the spool 6, first and second pilot pressure chambers 13*a* and 13*b* are formed, respectively. Between the pistons 12*a* and 12*b*, and the end faces of the spool 16, there are formed breathing chambers 9 and 9 which are opened to the outside, respectively. The pressure chambers 13*a* and 13*b* are hermetically shut off from the breathing chambers 9 and 9 by piston packing 15 and 15 mounted on the outer peripheries of the piston 12*a* and 12*b*, respectively.

The first pressure chamber 13*a* situated adjacent to the first piston 12*a* of large diameter communicates with the supply port P through the pilot fluid passages 16*a* and 16*b* via the above-mentioned pilot valve 2 and a manual operating mechanism 17, while the second pressure chamber 13*b* situated adjacent to the second piston 12*b* of small diameter always communicates with the supply port P through the pilot fluid passage 16*c*.

Figure 2:
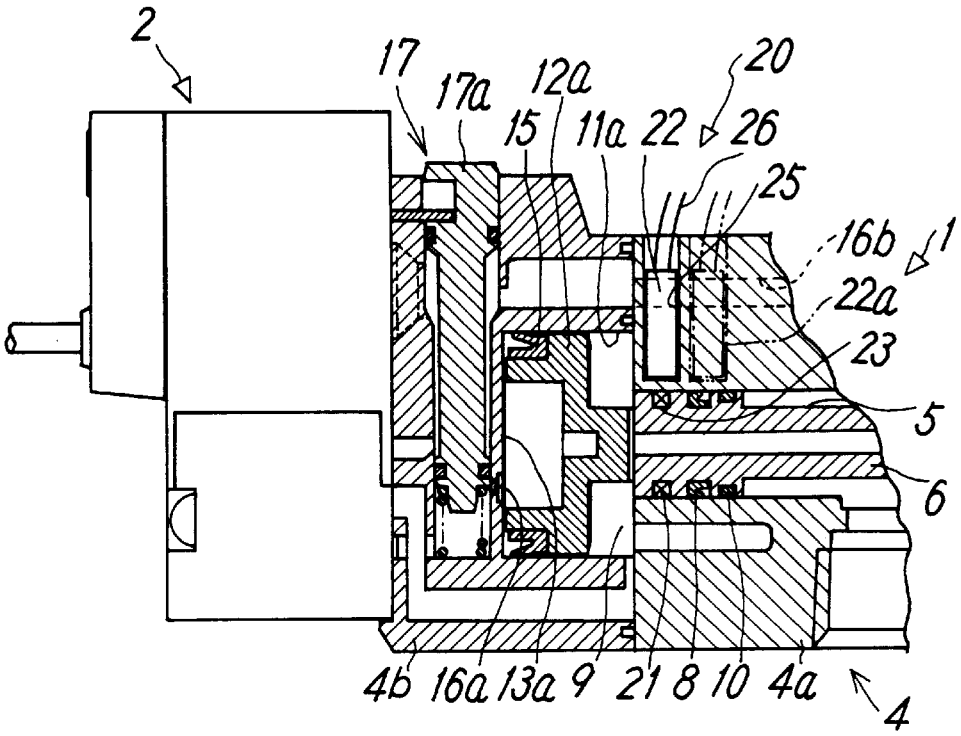
FIG. 2 is an enlarged view showing the main section of FIG. 1.
Figure 3:
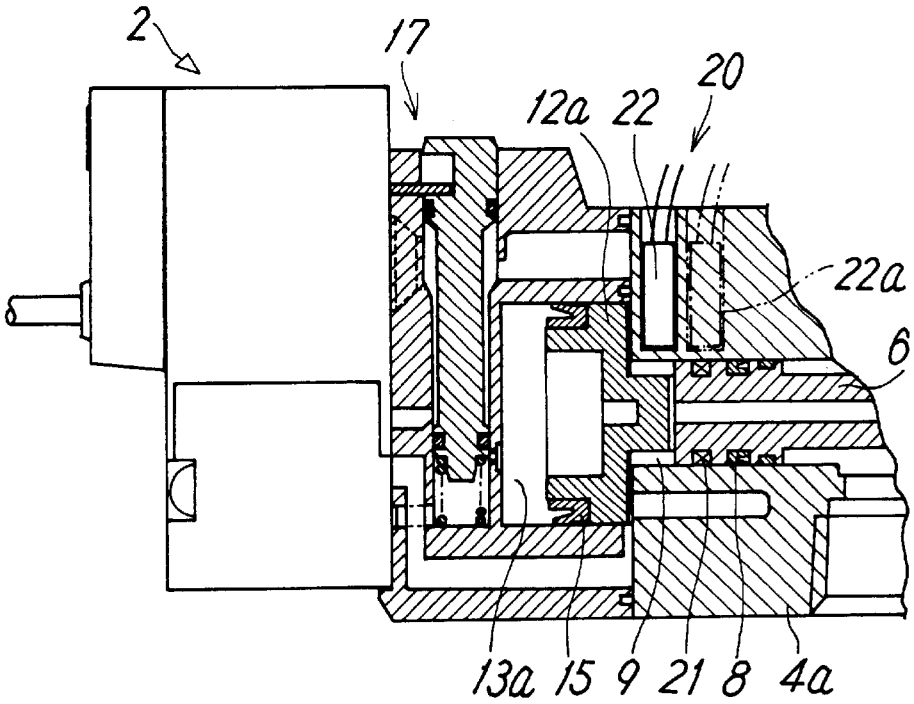
FIG. 3 is an enlarged view of the main section which is similar to FIG. 2, but which shows a state of operation differing from that in FIG. 2.

When the pilot valve 2 is in the "off" state, that is, when the first pressure chamber 13*a* is not supplied with a pilot fluid, the second piston 12*b* is pushed by the pilot fluid pressure supplied to the second pressure chamber 13*b*, so that the spool 6 becomes situated at the first changeover position shifted to the left side, as shown in FIG. 1 or FIG. 2. Once the pilot valve 2 is turned "on", that is, the first pressure chamber 13*a* is supplied with a pilot fluid, the spool 6 is pushed by the first piston 12*a*, so that the spool 6 moves to the right side and occupies the second changeover position, as shown in FIG. 3. This is because the acting force of fluid pressure acting on the first piston 12*a* is larger than that acting on the second piston 12*b* due to the difference in the pressure receiving area between the two piston 12*a* and 12*b*.

Here, the spool 6 and each of the pistons 12*a* and 12*b* may be coupled.

The above-mentioned manual operating mechanism 17 is adapted to directly connect the pilot fluid passages 16*a* and 16*b* by depressing an operating element 17*a*, and to thereby make the first pressure chamber 13*a* communicate with the supply port P. This operating state is the same as that in which the pilot valve 2 is "on".

The pilot valve 2 is an electromagnetically operated solenoid valve for opening/closing pilot fluid passages by energizing a solenoid. Since its constitution and operation are the same as the known one, specific explanation thereof is omitted.

The above-described directional control valve is provided with a position detecting mechanism 20 for detecting operating positions of the spool 6. The position detecting mechanism 20 comprises a magnet 21 installed on the spool 6 and a magnetic sensor 22 which is installed at a predetermined position on the casing 4 side and detects the magnetism from the magnet 21. The position detecting mechanism 20 is adapted to detect, by means of the magnetic sensor 22, the magnetic flux density when the magnet 21 moves together with the spool 6, and detects all operating positions of the spool 6 during a stroke, from the changes in magnetic flux density.

The above-described magnet 21 is produced by mixing the metallic powder having magnetic property into soft elastic base material such as synthetic resin or synthetic rubber and forming the obtained mixture into annular body having a notch at a part of circumference thereof. The magnet 21 is installed on the outer periphery of any one end side of the spool 6, for example, on the outer periphery of the end portion of the spool 6 opposite to the first piston 12*a*, as in the case of the present embodiment, so as to be situated at a position which is adjacent to the breathing chamber 9 and is more exterior than the end sealing member 8. More specifically, the magnet 21 is installed at the above-mentioned position by fitting the annular magnet 21 into a mounting groove 23 formed on the outer periphery of the end portion of e spool 6, in a state where the diameter thereof is elastically expanded.

In this case, it is preferable to make the thickness of the magnet 21 slightly less than the depth of the mounting groove 23 so that the outer peripheral surface of the magnet 21 becomes lower than that of the spool 6 in order to prevent the outer peripheral surface of the valve hole 5 from rubbing against the inner peripheral surface of spool 6. This permits not only the prevention of the increase in sliding resistance of the piston 12*a* due to the rubbing of the magnet 21 against the inner peripheral surface of the spool 6, but also the prevention of suffering an adverse effect on the sliding of the spool 6 even if the magnet 21 adsorbs some magnetic particulates in the atmosphere.

Thus, by disposing the magnet 21 at a position which is adjacent to the breathing chamber 9 and is more exterior than the end sealing member 8 of an end of the spool 6 so as to be shut off from the flow passages of the hydraulic fluid in the valve hole 5, the magnet 21 can be prevented from directly contacting the pilot fluid. As a consequence, even if the pilot fluid contains water, chemical mist, magnetic particles such as metallic powder, or the like, there is no risk of the magnet rusting, corroding, or adsorbing magnetic particulates due to the contact of the magnet 21 with these substances. This prevents the reduction in position detecting accuracy due to the decrease in magnetic force, or the occurrence of a malfunction of the spool 6 due to adsorbed particulates.

On the other hand, the magnetic sensor 22 is installed at a position adjacent to the magnet 21, in the housing 25 formed in the first member 4*a* of the casing 4, so as to be able to detect the magnetism from the magnet 21 over the whole stroke of the spool 6. More specifically, the magnetic sensor 22 is installed at a position such that the magnetic sensor 22 is the closest to the magnet 21 when the piston 12*a* is situated at any one of the stroke ends. Thereby, the magnetic sensor 22 detects the highest magnetic flux density when the spool 6 is situated at the above-mentioned stroke end of the spool 6, and detects the lowest magnetic flux density when the spool 6 is situated at the other end of the spool 6. In this case, the lowest magnetic flux density may be zero.

The magnetic sensor 22 is adapted to be connected to a discriminating circuit (not shown) through a lead wire 26, and to output a detection signal in response to a magnetic flux density to this discriminating circuit. In this discriminating circuit, data necessary for position detecting such as the interrelations of each operating position with the magnetic flux density, operating time, and fluid pressure when the spool 6 normally operates, have been inputted in advance. Once a detection signal from the magnetic sensor 22 is inputted, the discrimination circuit measures the positions of both stroke ends of the spool 6 and each position during a stroke based on the above-mentioned data, and can discriminate whether the operation of the spool 6 has been normal or not, from the relations between the operating time and the position of the spool 6 from the initiation to the termination of a stroke thereof. Thereby, it is possible to detect a sign of failure and to take precautionary measures against a failure, and thereby to avoid an situation such that the operation of device stops for a long time due to the occurrence of a failure or an accident.

Herein, the operating positions, the operating times, etc. for the spool 6 which have been detected, can be displayed on a display device in the form of numeral values or graphs.

In the above-described embodiment, one magnetic sensor 22 is disposed so as to be situated at a position opposite to the magnet 21 at one stroke end, but the magnetic sensor 22 may be disposed at any suitable position within the moving range of the magnet 21, if only the position is one from which the operating positions over the whole stroke of the spool 6 can be identified from the change in magnetic flux density.

Alternatively, two magnetic sensors 22 and 22*a* may be each provided at a position opposite to the magnet 21 on both stroke ends of the spool 6, as shown with a solid line and a chain line in FIGS. 2 and 3. In this case, when the spool 6 is situated at the stroke end shown in FIG. 2, the first magnetic sensor 22 detects the highest magnetic flux density, and the second magnetic sensor 22*a* detects the lowest magnetic flux density. When the spool 6 is situated at the stroke end shown in FIG. 3, the second magnetic sensor 22*a* detects the highest magnetic flux density, and the first magnetic sensor 22 detects the lowest magnetic flux density. When the spool 6 is situated on the way of a stroke, the two magnetic sensors 22, 22*a* detect the magnetic flux densities in accordance with the distance from the magnet 21. Thereby, it is possible to know operating the positions of the spool 6 from the changes in magnetic flux density detected by the two magnetic sensors 22, 22*a*.

Here, the above-described second magnetic sensor 22*a* may be disposed on the other end side of the spool 6. In this case, on the other end side, the second magnet is installed. The positional relations between the two sets of magnets and magnetic sensors situated at both ends of the spool 6 is as follows. At one stroke end of the spool 6, when one magnetic sensor detects the highest magnetic flux density, the other magnetic sensor detects the lowest magnetic flux density. At the other stroke end, the situation is in inverse relation to the former case.

Figure 4:
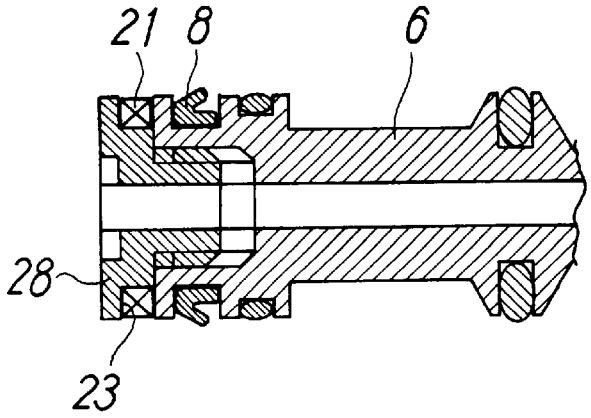
FIG. 4 is a sectional view showing the main section of a spool in a second embodiment of the present invention.

In the above-described embodiment, the magnet 21 is directly mounted on the outer periphery of the spool 6, but may be mounted indirectly thereon via a holder. For example, as in the second embodiment shown in FIG. 4, the magnet 21 may be mounted in the manner wherein a plug-shaped holder 28 formed of non-magnetic material is screwed into the end face of the spool 6, and wherein the magnet 21 is installed into the mounting groove 23 which is formed between the step portion on the outer periphery of this holder 28 and the end face of the spool 6. Alternatively, the magnet 21 may be installed in the other manner wherein an independent mounting groove is formed on the outer periphery of the above-mentioned holder 28, wherein the magnet is installed in this mounting groove, and wherein the holder is coupled to the end face of the spool 6 with a suitable means such as screwing.

Figure 5:
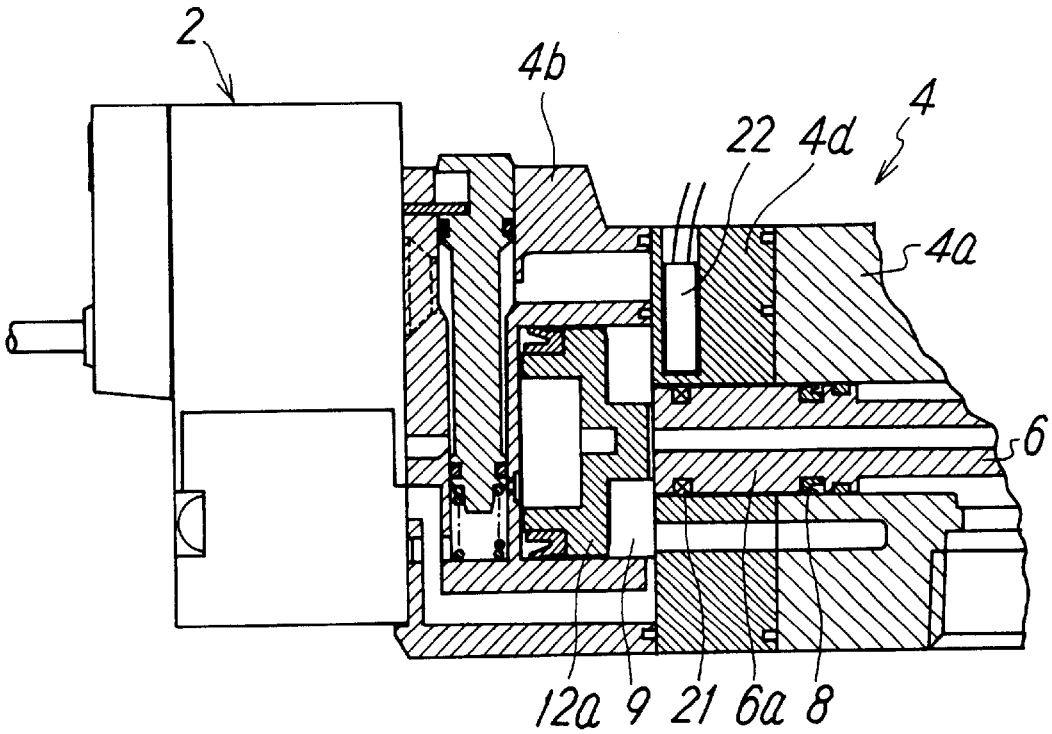
FIG. 5 is a longitudinal sectional view showing the main section of a third embodiment of the present invention.

FIG. 5 shows the main section of the third embodiment of the present invention. The difference between the above-described first embodiment and the third embodiment is that in the first embodiment the magnetic sensor 22 is directly installed on the first member 4*a* of the casing 4, whereas in the third embodiment the forth member 4*d* dedicated to sensor mounting is interposed between the first member 4*a* and the second member 4*b*, and the magnetic sensor 22 is installed on this forth member 4*d*. In this case, the end portion of the spool 6 is extended by the length of the size of the forth member 4*d*, and the magnet 21 is installed on the extended portion 6*a*.

Since constitutions and operations, or modifications of the third embodiment other than the foregoing are substantially the same as those of the first embodiment, description thereof is omitted.

In each of the above-described embodiments, as the valve member, a spool was shown, but the valve member is not limited to a spool. For example, even if the valve member is of a poppet type, the present invention may be applied to it, if it has, on at least one end side, a sliding portion for sliding in the valve hole, and if it has, on this sliding portion, an end sealing member for shutting off the breathing chamber from the flow passages. Also, the directional control valve of the present invention may be of a spring-return type which has a return spring in place of the second piston 12*b* of small diameter, and which always energizes the spool in the return direction by the return spring.

Furthermore, the type of the directional control valve is not particularly limited to the single-pilot type as in the above-described embodiments, but a double-pilot type directional control valve may be used, or a direct-acting type directional control valve in which the valve member is directly driven by electromagnetic or mechanical driving means may be employed.

Moreover, the above-described position detecting mechanism 20 does not necessarily require using the above-described method in which all operating positions of the spool are detected from the change in magnetic flux density with the movement of the spool, but the position detecting mechanism 20 may use a method in which only both stroke ends of the spool are detected at both stroke ends of the spool by turning on/off the magnetic sensor.

As has been described hereinbefore in detail, in accordance with the present invention, there is provided a directional control valve excellent in the detecting accuracy and the operational stability and having a position detecting function, wherein the magnet is prevented from directly contacting hydraulic fluid so as not to be affected by the hydraulic fluid.

What is claimed is:

1. A directional control valve having a position detecting function, comprising:

a plurality of ports;

a valve hole, wherein each of said plurality of ports is opened to said valve hole;

a casing having said plurality of ports and said valve hole therein;

a valve member for changing over fluid flow passages, said valve member being received in said valve hole;

driving means for driving said valve member;

a magnet installed so as to be displaced in synchronization with said valve member, said magnet being disposed at a position which is shut off from said fluid flow passages, and which is adjacent to at least one end of said valve member;

at least one magnetic sensor installed so as to be able to detect magnetism from said magnet, said at least one magnetic sensor being disposed at a portion opposite to said magnet in said casing;

breathing chambers opened to an outside, each of said breathing chambers being disposed at positions facing end faces of said valve member;

end sealing members for shutting off said breathing chambers from said fluid flow passages in said valve hole, said end sealing members being installed on outer peripheries of end portions of said valve member; and said magnet being installed at a first end portion of said end portions of said valve member, said first end portion being adjacent to one of said breathing chambers and being more exterior that one of said end sealing members.

2. The directional control valve as claimed in claim 1, wherein said at least one magnetic sensor is a plurality of magnet sensors, said plurality of magnetic sensors simultaneously detecting said magnetism from said magnet.

3. The directional control valve as claimed in claim 1, wherein said at least one magnetic sensor is disposed at a position where said magnetic at least one sensor can detect said magnetism from said magnet over a whole stroke of said valve member, and wherein said at least one magnetic sensor can detect all operating positions of said valve member from a change in magnetic flux density with a displacement of said magnet.

4. The directional control valve as claimed in claim 2, wherein each of said plurality of magnetic sensors is disposed at a position where each of said plurality of magnetic sensors can detect said magnetism from said magnet over a whole stroke of said valve member, and wherein each of said plurality of magnetic sensors can detect all operating positions of said valve member from a change in magnetic flux density with a displacement of said magnet.

5. The directional control valve as claimed in claim 1, wherein said magnet is installed into a mounting groove which is directly grooved in an outer periphery of said valve member.

6. The directional control valve as claimed in claim 1, wherein said magnet is directly installed on said valve member with a holder connected to one of said end portions of said valve member.

7. A directional control valve having a position detecting function, comprising:

a plurality of ports;

a valve hole, wherein each of said plurality of ports is opened to said valve hole;

a casing having said plurality of ports and said valve hole therein;

a valve member for changing over fluid flow passages, said valve member being slidably received in said valve hole;

a pair of pistons, wherein each of said pair of pistons is disposed at first and second ends of said valve member, each of said pair of pistons abutting first and second end faces of said first and second ends, respectively, of said valve member;

at least one pilot valve for change over said valve member by controlling a pilot fluid action on said pair of pistons;

breathing chambers opened to an outside, each of said breathing chambers being formed between said first and second end faces of said first and second ends, respectively, of said valve member and each of said pair of pistons;

end sealing members for shutting off said breathing chambers from said fluid flow passages in said valve hole, said end sealing members being installed on outer peripheries of said first and second ends of said valve member;

a magnet installed on at least one end side of said valve member so as to be situated as a position which is adjacent to one of said breathing chambers and which is more exterior than any one of said end sealing members; and at least one magnetic sensor installed so as to be able to detect magnetism from said magnet, said at least one magnetic sensor being disposed at a portion opposite to said magnet in said casing.

8. The directional control valve as claimed in claim 7, wherein said at least one magnetic sensor is a plurality of magnet sensors, said plurality of magnetic sensors simultaneously detecting said magnetism from said magnet.

9. The directional control valve as claimed in claim 8, wherein each of said plurality of magnetic sensors is disposed at a position where each of said plurality of magnetic sensors can detect said magnetism from said magnet over a whole stroke of said valve member, and wherein each of said plurality of magnetic sensors can detect all operating positions of said valve member from a change in magnetic flux density with a displacement of said magnet.

10. The directional control valve as claimed in claim 7, wherein said at least one magnetic sensor is disposed at a position where said magnetic at least one sensor can detect said magnetism from said magnet over a whole stroke of said valve member, and wherein said at least one magnetic sensor can detect all operating positions of said valve member from a change in magnetic flux density with a displacement of said magnet.

11. A directional control valve having a position detecting function, comprising:

a plurality of ports;

a valve hole, wherein each of said plurality of ports is opened to said valve hole;

a casing having said plurality of ports and said valve hole therein;

a valve member configured to change over fluid flow passages, said valve member being slidably received in said valve hole;

driving means configured to drive said valve member;

a magnet installed so as to be displaced in synchronization with said valve member, said magnet being disposed at a position which is shut off from said fluid flow passages, and which is adjacent to at least one end of said valve member;

at least one magnetic sensor installed so as to be able to detect magnetism from said magnet, said at least one magnetic sensor being disposed at a portion opposite to said magnet in said casing;

breathing chambers opened to an outside, each of said breathing chambers being disposed at positions facing end faces of said valve member;

end sealing members configured to shut off said breathing chambers from said fluid flow passages in said valve hole, said end sealing members being installed on outer peripheries of end portions of said valve member; and said magnet being installed at a first end portion of said end portions of said valve member, said first end portion being adjacent to one of said breathing chambers and being more exterior that one of said end sealing members.

12. The directional control valve as claimed in claim 11, wherein said at least one magnetic sensor is a plurality of magnet sensors, said plurality of magnetic sensors simultaneously detecting said magnetism from said magnet.

13. The directional control valve as claimed in claim 12, wherein each of said plurality of magnetic sensors is disposed at a position where each of said plurality of magnetic sensors can detect said magnetism from said magnet over a whole stroke of said valve member, and wherein each of said plurality of magnetic sensors can detect all operating positions of said valve member from a change in magnetic flux density with a displacement of said magnet.

14. The directional control valve as claimed in claim 11, wherein said at least one magnetic sensor is disposed at a position where said magnetic at least one sensor can detect said magnetism from said magnet over a whole stroke of said valve member, and wherein said at least one magnetic sensor can detect all operating positions of said valve member from a change in magnetic flux density with a displacement of said magnet.

15. The directional control valve as claimed in claim 11, wherein said magnet is installed into a mounting groove which is directly grooved in an outer periphery of said valve member.

16. The directional control valve as claimed in claim 11, wherein said magnet is directly installed on said valve member with a holder connected to one of said end portions of said valve member.

17. A directional control valve having a position detecting function, comprising:

a plurality of ports;

a valve hole, wherein each of said plurality of ports is opened to said valve hole;

a casing having said plurality of ports and said valve hole therein;

a valve member configured to change over fluid flow passages, said valve member being slidably received in said valve hole;

a pair of pistons, wherein each of said pair of pistons is disposed at first and second ends of said valve member, each of said pair of pistons abutting first and second end faces of said first and second ends, respectively, of said valve member;

at least one pilot valve configured to change over said valve member by controlling a pilot fluid action on said pair of pistons;

breathing chambers opened to an outside, each of said breathing chambers being formed between said first and second end faces of said first and second ends, respectively, of said valve member and each of said pair of pistons;

end sealing members configured to shut off said breathing chambers from said fluid flow passages in said valve hole, said end sealing members being installed on outer peripheries of said first and second ends of said valve member;

a magnet installed on at least one end side of said valve member so as to be situated as a position which is adjacent to one of said breathing chambers and which is more exterior than any one of said end sealing members; and at least one magnetic sensor installed so as to be able to detect magnetism from said magnet, said at least one magnetic sensor being disposed at a portion opposite to said magnet in said casing.

18. The directional control valve as claimed in claim 17, wherein said at least one magnetic sensor is a plurality of magnet sensors, said plurality of magnetic sensors simultaneously detecting said magnetism from said magnet.

19. The directional control valve as claimed in claim 18, wherein each of said plurality of magnetic sensors is disposed at a position where each of said plurality of magnetic sensors can detect said magnetism from said magnet over a whole stroke of said valve member, and wherein each of said plurality of magnetic sensors can detect all operating positions of said valve member from a change in magnetic flux density with a displacement of said magnet.

20. The directional control valve as claimed in claim 17, wherein said at least one magnetic sensor is disposed at a position where said magnetic at least one sensor can detect said magnetism from said magnet over a whole stroke of said valve member, and wherein said at least one magnetic sensor can detect all operating positions of said valve member from a change in magnetic flux density with a displacement of said magnet.

* * * * *